US006460634B1

(12) United States Patent
Hart et al.

(10) Patent No.: US 6,460,634 B1
(45) Date of Patent: Oct. 8, 2002

(54) PIPE CLAMP

(76) Inventors: Christopher A Hart, 903 Hodgkins #104, Houston, TX (US) 77032; David Cannan, 903 Hodgkins #104, Houston, TX (US) 77032

( * ) Notice: Subject to any disclaimer, the term of this patent is extended or adjusted under 35 U.S.C. 154(b) by 0 days.

(21) Appl. No.: 09/661,687

(22) Filed: Sep. 14, 2000

Related U.S. Application Data

(63) Continuation-in-part of application No. 09/234,333, filed on Jan. 20, 1999, now Pat. No. 6,138,776.

(51) Int. Cl.[7] ..... E21B 19/14
(52) U.S. Cl. ..... 175/85; 166/77.5; 81/57.16
(58) Field of Search ..... 175/40, 85; 166/85, 166/77.5, 78; 173/164, 21, 163; 81/57.16, 57.34, 54, 52, 57.39

(56) References Cited

U.S. PATENT DOCUMENTS 3,797,260 A * 3/1974 Webb ..... 61/72.1
3,805,646 A * 4/1974 Knight ..... 81/69
3,891,039 A * 6/1975 Lagerstrom ..... 175/40
4,099,429 A * 7/1978 Hauk ..... 81/57.17
4,324,157 A * 4/1982 Soutsos ..... 81/57.17
4,423,647 A * 1/1984 Toelke ..... 81/57.34
4,885,963 A * 12/1989 Nishikawa ..... 81/57.23
5,123,484 A * 6/1992 Bode ..... 166/85

* cited by examiner

*Primary Examiner*—Robert E. Pezzuto
(74) *Attorney, Agent, or Firm*—Browning Bushman P.C.

(57) ABSTRACT

A pipe clamp for use in oil field operations is provided. The pipe clamp is particularly useful where pipe, casing or tubing must be grasped firmly. The pipe clamp is designed to be safer than existing technology by incorporating a lighter weight design that is self aligning and can be controlled from a relatively remote location. The pipe clamp is comprises a gripping head which wraps around the pipe, an actuator extending radially from the gripping head, and a chain wrapped around the gripping head and connected to a mount located at the radially distant end of the actuator. As the actuator extends, it increases the distance between the gripping head and the mount, thus the chain tightens the friction surfaces of the gripping head about the pipe.

12 Claims, 5 Drawing Sheets

PIPE CLAMP

This is a continuation in part of U.S. patent application Ser. No. 09/234,333, filed Jan. 20, 1999, now U.S. Pat. No. 6,138,776.

FIELD OF THE INVENTION

The present invention relates generally to oil field equipment and, more particularly to, to a clamp used to firmly grasp tubulars in making up and breaking down joints of the tubulars.

BACKGROUND OF THE INVENTION

In handling pipe, tubing, or casing in and around a drilling rig, there are several operations which require a mechanism for firmly grasping the pipe. This has been accomplished in the past by utilizing various means ranging from devices manually wrapped around the pipe to power tongs frequently used today. The power tongs are mainly used to thread and unthread sections, or joints, of pipe when either forming or breaking down a string. In this application, two sets of power tongs are usually used. The primary set of power tongs spins a joint of pipe into or out of the string below. This setup is used both to thread joints and unthread joints, and in both operations the torque applied can be great.

Typically, the string below is retained vertically by a set of slips which wedge between the string and a bowl. These slips, however, simply provide vertical support and are not designed to counteract the torque being applied to the string by the primary power tongs. Therefore a backup set of power tongs is usually employed to hold the string fast against the torque being applied from the primary power tong.

Because of their substantial weight, power tongs are typically suspended in the drilling rig by counter weighted chains. The primary and backup tongs are sometimes hung separately and sometimes connected as a single unit. In either configuration, current power tongs are heavy and cumbersome. This is an important safety consideration. The greater the mass of machinery which is movable in an area the more likely that an injury will occur. The idea of combining the two tongs lets the worker focus on one large moving piece of machinery rather than worrying about multiple machines. However, this poses a problem in that the combined machine can weigh about twice as much as a single power tong.

Another approach to this problem is to attach the backup power tongs to the slips. The backup power tongs are thereby fixed in one location. This allows the primary power tongs to be the only hanging machinery in this operation and the focus of the worker's attention.

Of note in either of these arrangements is that while the primary power tongs need to simultaneously grasp and spin the pipe joint being attached to the string, the backup power tongs need only grasp the string. It would be advantageous to have a power tong specially designed to only hold the pipe that is lighter and more versatile than the current backup power tong.

The backup power tongs currently in operation have another problem besides their significant weight. If a backup power tong is fixed to the slips or the platform floor and required to grasp a pipe which is fixed, the power tong and pipe are often not perfectly aligned. This misalignment can cause the backup power tong to bend the pipe or string while grasping it. It would be advantageous to have a backup power tong specially designed to be self aligning so that bending stresses are not exerted on the pipe or string.

Another application which requires a mechanism to firmly grasp the string is what is commonly referred to as a safety clamp. This is a clamp which is positioned on pipe to prevent slippage of the pipe through a set of slips. Typically, these are manually applied to a pipe. Two problems with this are that they require a worker to be in a dangerous area and the manual application does not always ensure a firm hold on the pipe. It would be advantageous to keep the worker's hands away from such operations as much as possible and provide controlled pressure on the pipe.

SUMMARY OF THE INVENTION

The present invention is a pipe clamp for use where a lighter, remotely controlled, self-aligning mechanism for firmly grasping a pipe, tubing, casing or string is needed. This invention may be used in place of a backup set of power tongs, or alternatively as a safety clamp used in conjunction with a set of slips. The pipe clamp comprises a gripping head which wraps around the pipe, an actuator extending radially from the gripping head, and a chain wrapped around the gripping head and connected to a mount located at the radially distant end of the actuator. As the actuator expands, the chain tightens the friction surfaces of the gripping head about the pipe. The actuator floats between the gripping head and the mount giving the pipe clamp a self aligning feature. Where the actuator is hydraulic, the pipe clamp can easily be controlled from a safe, relatively remote, distance. A safety cage enclosing the mechanism is also provided which increases the safety of the device when in use.

The pipe clamp is considerably lighter than a typical set of backup power tongs. Therefore, the pipe clamp can be attached to a primary power tong without increasing the weight of the unit as much as a standard backup power tong unit would. The pipe clamp can also be attached to a slip bowl to provide a stationary backup that is safer to use than the typical power tong because of the pipe clamp's remote operation capability. Such an application could include a set of power slips that are also remotely operated. In such an application, the only operation that the worker need worry about is the operation of the primary power tongs. A safety cage covering the power slips and pipe clamp provides added protection for the worker who remains in the area to operate the primary power tongs.

The pipe clamp can also be used as a safety clamp in conjunction with a set of slips. The pipe clamp is attached to a section of pipe extending above the slips and provides a stop in the event the pipe starts to slide through the slips. Such safety clamps are commonly manual devices. The pipe clamp of this invention allows for remote operation to keep workers out of the area as much as possible and provides a controlled grip on the pipe to ensure a firm grasp.

These and other features and advantages of the present invention will be apparent to those skilled in the art from a review of the following disclosure along with the accompanying drawings.

DETAILED DESCRIPTION OF A PREFERRED EMBODIMENT

Figure 1:
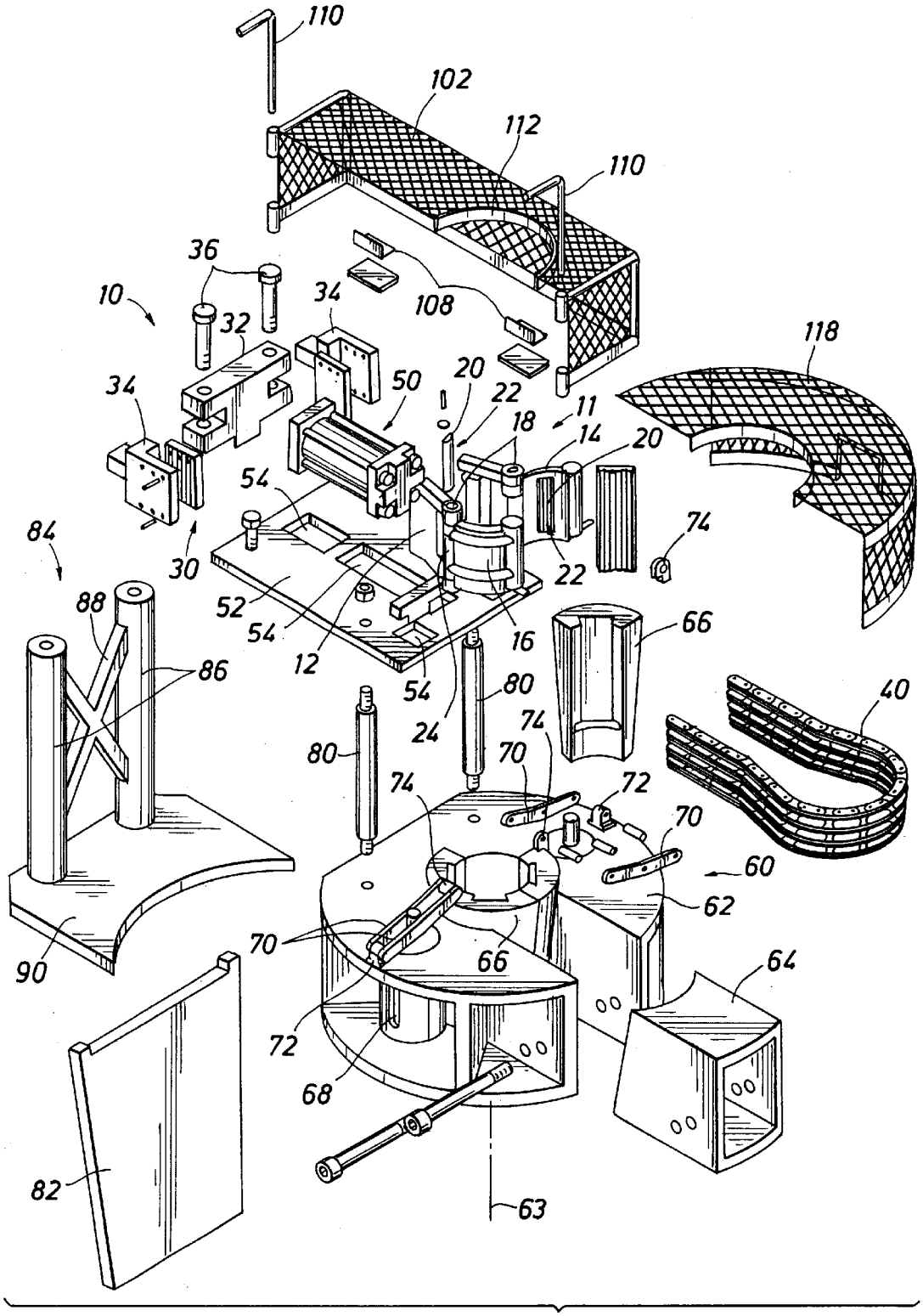
FIG. 1 is an exploded perspective view of the pipe clamp of the present invention attached to a set of power slips.

FIG. 1 depicts an exploded view of a pipe clamp 10 in accordance with the present invention. The pipe clamp 10 comprises a gripping head 11 which wraps around the pipe, an actuator 50 extending radially from the gripping head 11, and a chain 40 wrapped around the gripping head 11. The chain 40 also connects to a mount 30 located at the radially distant end of the actuator 50.

The gripping head 11 comprises a base 12 and at least one gripping jaw 14. The preferred embodiment of the pipe clamp includes a pair of jaws 14, 16 attached to the base 12 with hinges 18. The jaws 14, 16 and base 12 are lined with removable gripping inserts 20 which are designed to be replaced when worn out. The inserts 20 have a toothed inner surface 22 to provide a firm grasp on a pipe 15 (FIG. 2) when they are pressed against the pipe 15. The jaws 14, 16 of the preferred embodiment are biased into an open configuration by springs 24 located in the hinges 18 to assist in positioning the jaws 14, 16 around the pipe 15.

The mount 30 further includes a yoke 32 to which buckles 34 are attached using yoke pins 36. This arrangement allows for the chain 40 to be easily removable from either side of the yoke 32. The pipe clamp 10 preferably uses a multi-link chain 40 that is flexible in a plane that is perpendicular to the pipe 15, but relatively stiff in any other direction.

The actuator 50 is preferably a hydraulic unit. The actuator 50 is controlled by a control panel 120 described in more detail below with regard to FIGS. 4 and 5. The actuator 50, gripping head 10, and mount 30 are all located on a plate 52. The plate 52 has slots 54 that allow the actuator 50, gripping head 11, and mount 30 to slide radially in relation to the pipe 15. This allows the pipe clamp 10 to be self aligning as described below.

As the actuator 50 is engaged, it expands the distance between the gripping head 11 and the mount 30. This can have different consequences depending on the gripping head's position relative to the pipe 15. If the gripping head 11 is firmly against the pipe 15, the actuator 50 primarily moves the mount 30 away from the pipe 15 thus tightening the chain 40 around the gripping head 11. If the gripping head 11 is away from the pipe 15 slightly, the actuator 50 moves the gripping head 11 toward the pipe 15, then tightens the chain 40 by increasing the distance between the mount 30 and the gripping head 11. This result stems from the fact that the gripping head 11 and the mount 30 are slidably attached to the plate 52, while the actuator 50 is only attached to the gripping head 11 and the mount 30. The plate 52 has slots 54 in which the gripping head 11 and the mount 30 are allowed to slide substantially radially with respect to the axis of the pipe 15. When torque is applied to the pipe 15 it is transferred through the gripping head 11, actuator 50, mount 30 and plate 52 to whatever structure the plate 52 is attached.

FIG. 1 shows the pipe clamp 10 attached to a set of power slips 60. The power slips 60, which may preferably be pneumatic, comprise a bowl 62 with a removable section 64 and a set of slip segments 66 that can be raised out of and lowered into the bowl 62 by controlling a pair of slip actuators 68. The bowl 62 and slip segments 66 are oriented about an axis 63, which also defines the axis of the pipe 15. The slip actuators 68 are attached pivotally to lifting arms 70 that are attached pivotally at one end to anchor rings 72 on the top of the bowl 62 and pivotally at the other end to lift rings 74 in the slip segments 66. The lift rings 74 on the slip segments 66 are positioned so that a single slip actuator 68 may lift a pair of slip segments 66.

The plate 52 is attached to the top of the bowl 62 by a pair of threaded rods 80 and to the side of the bowl 62 by a support member 82. At the rear of the plate 52 is a support assembly 84 made up of support legs 86 and bracing 88 attached to a panel 90 extending from the bottom of the bowl 62. Both the panel 90 and the bottom of the bowl 62 are attached firmly to the drilling platform (not shown).

Figure 2:
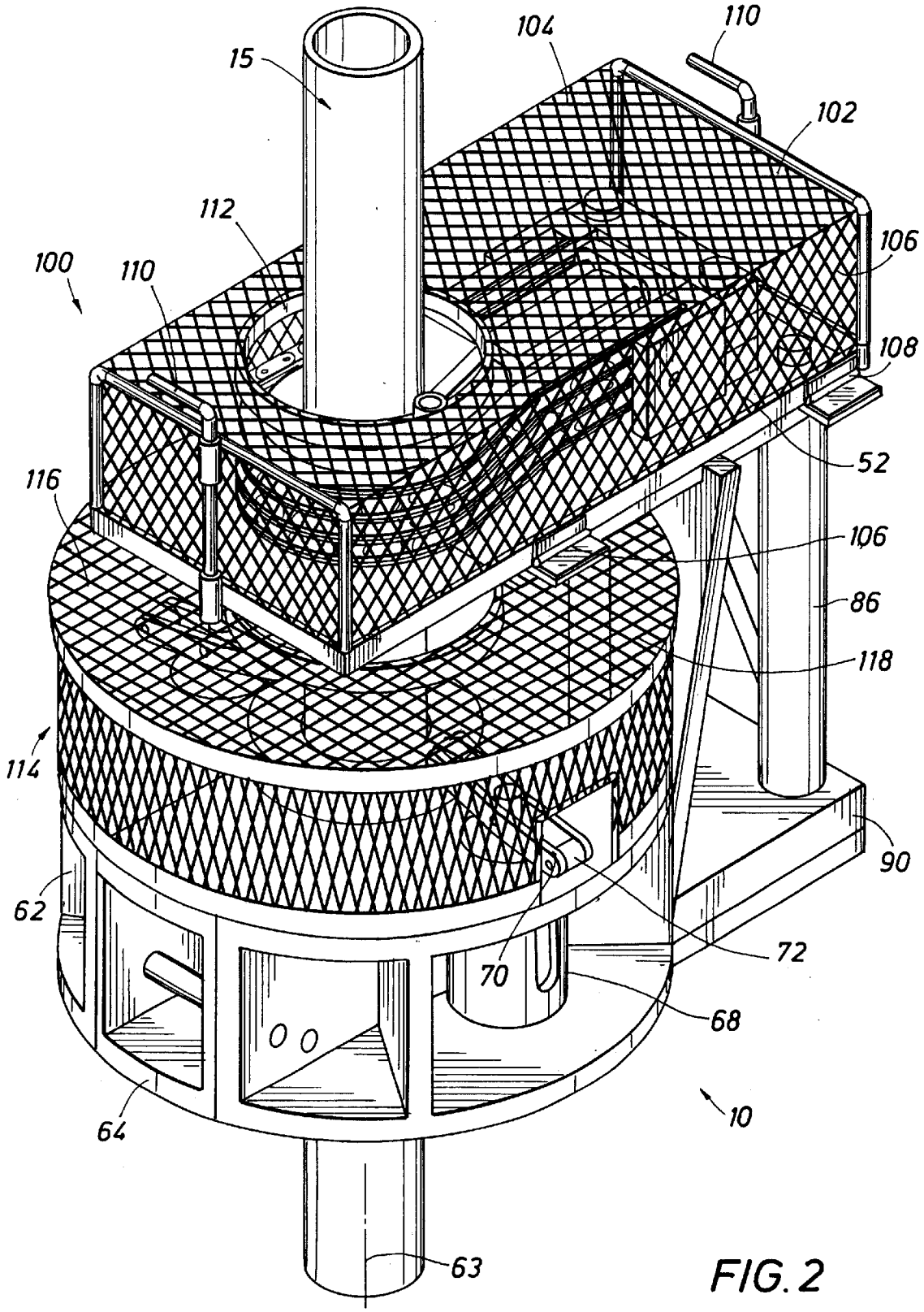
FIG. 2 is a perspective view of the pipe clamp attached to a set of power slips with safety cages enclosing both.
Figure 3:
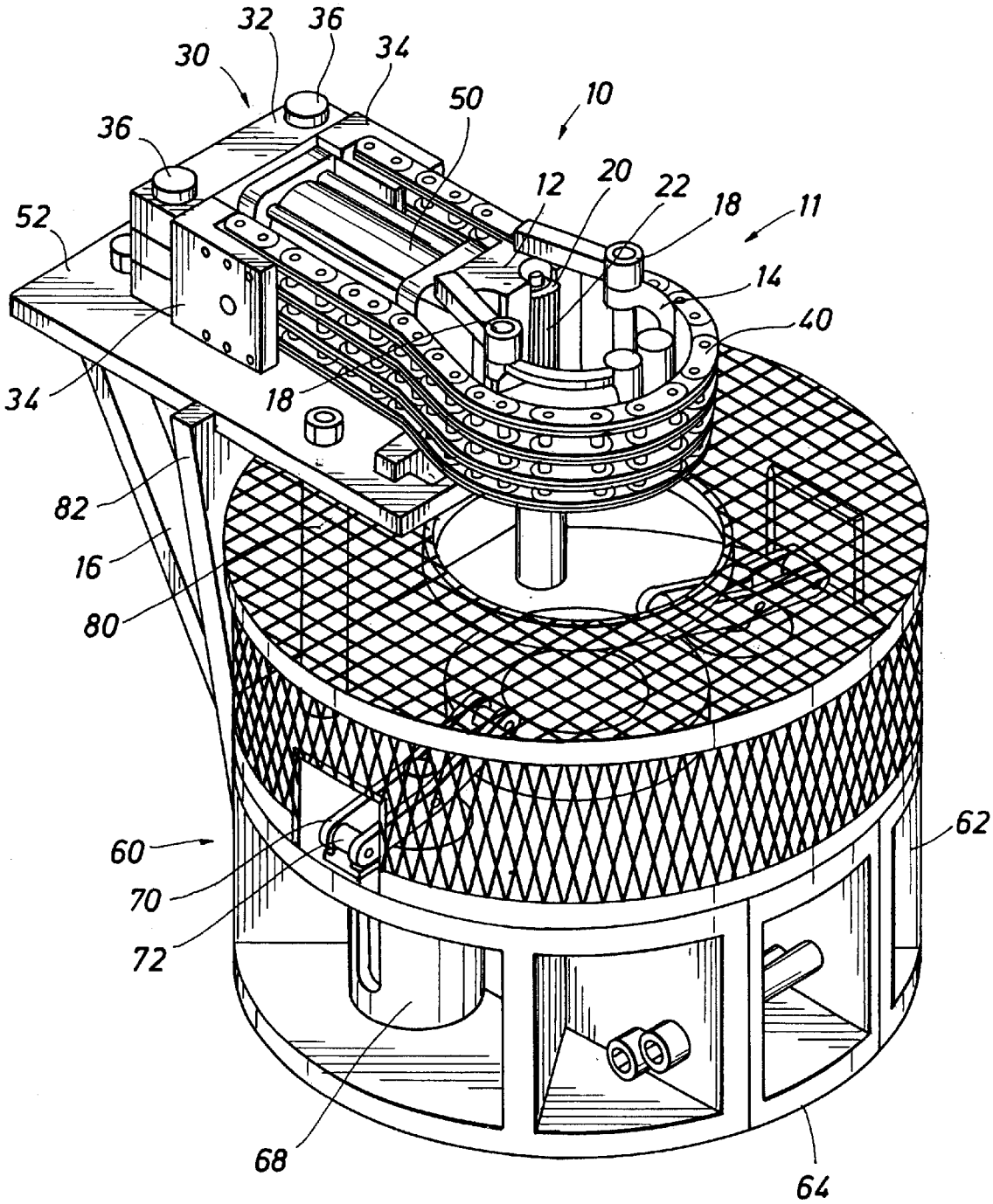
FIG. 3 is a perspective view of the pipe clamp attached to a set of power slips with a safety cage on the power slips only.

FIGS. 2 and 3 depict the pipe clamp 10 of the present invention from different aspects. The pipe clamp 10 is attached to a set of power slips 60 in perspective view with a set of safety cages 100, 102 installed. The pipe clamp safety cage 100 is split into two sections 104, 106 connected by hinges 108 to the edge of the plate 52 and connected to each other with retaining pins 110. Where the pipe clamp safety cage sections 104, 106 join there is a cut out 112 so that the pipe 15 may pass through the pipe clamp safety cage 100. The power slips 60 are covered by the power slip safety cage 114 which is split into two sections 116, 118 and constructed similarly to the pipe clamp safety cage.

Figure 4:
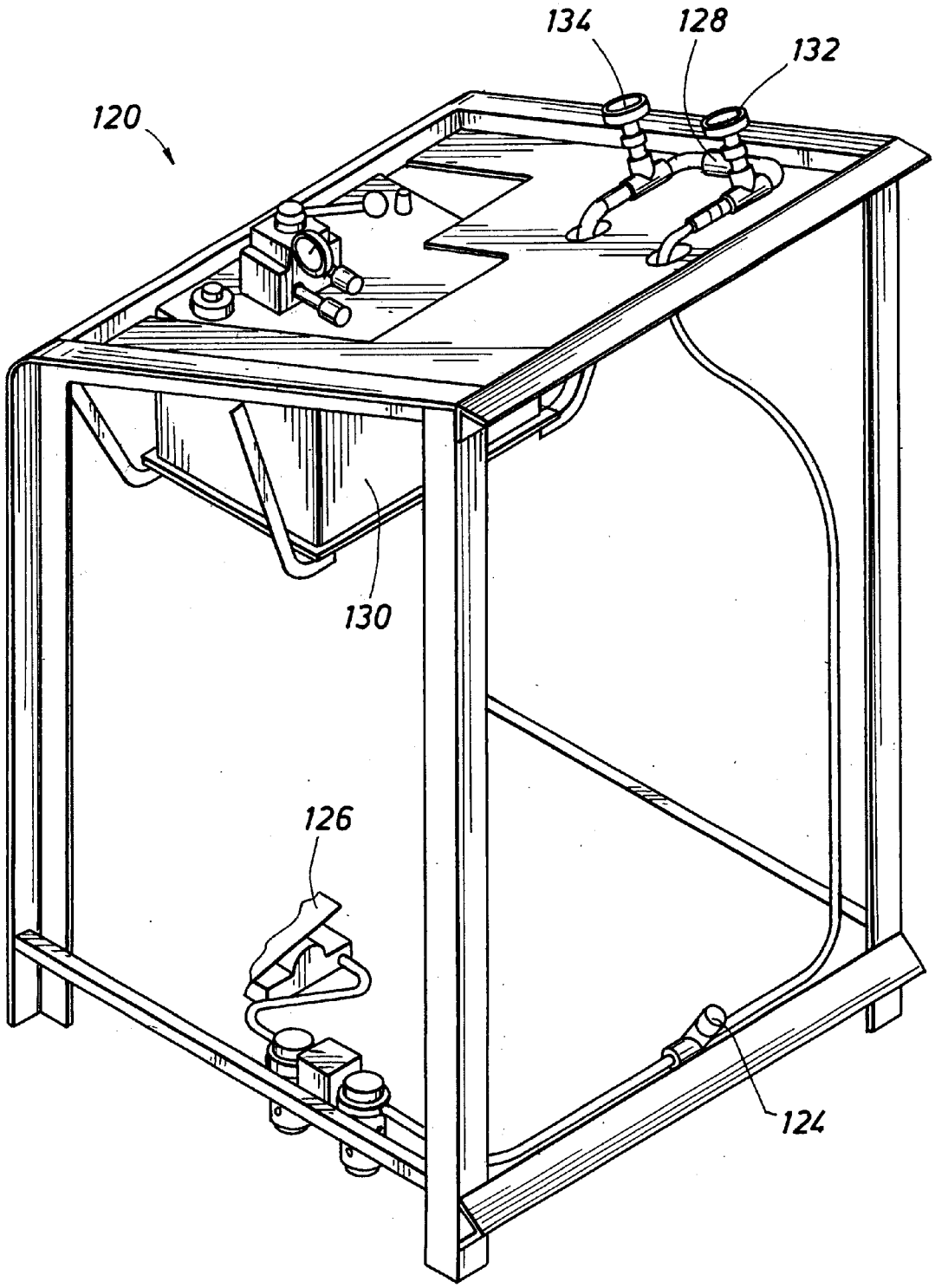
FIG. 4 is a perspective view of the rear of a control panel for operating the pipe clamp and a set of power slips.
Figure 5:
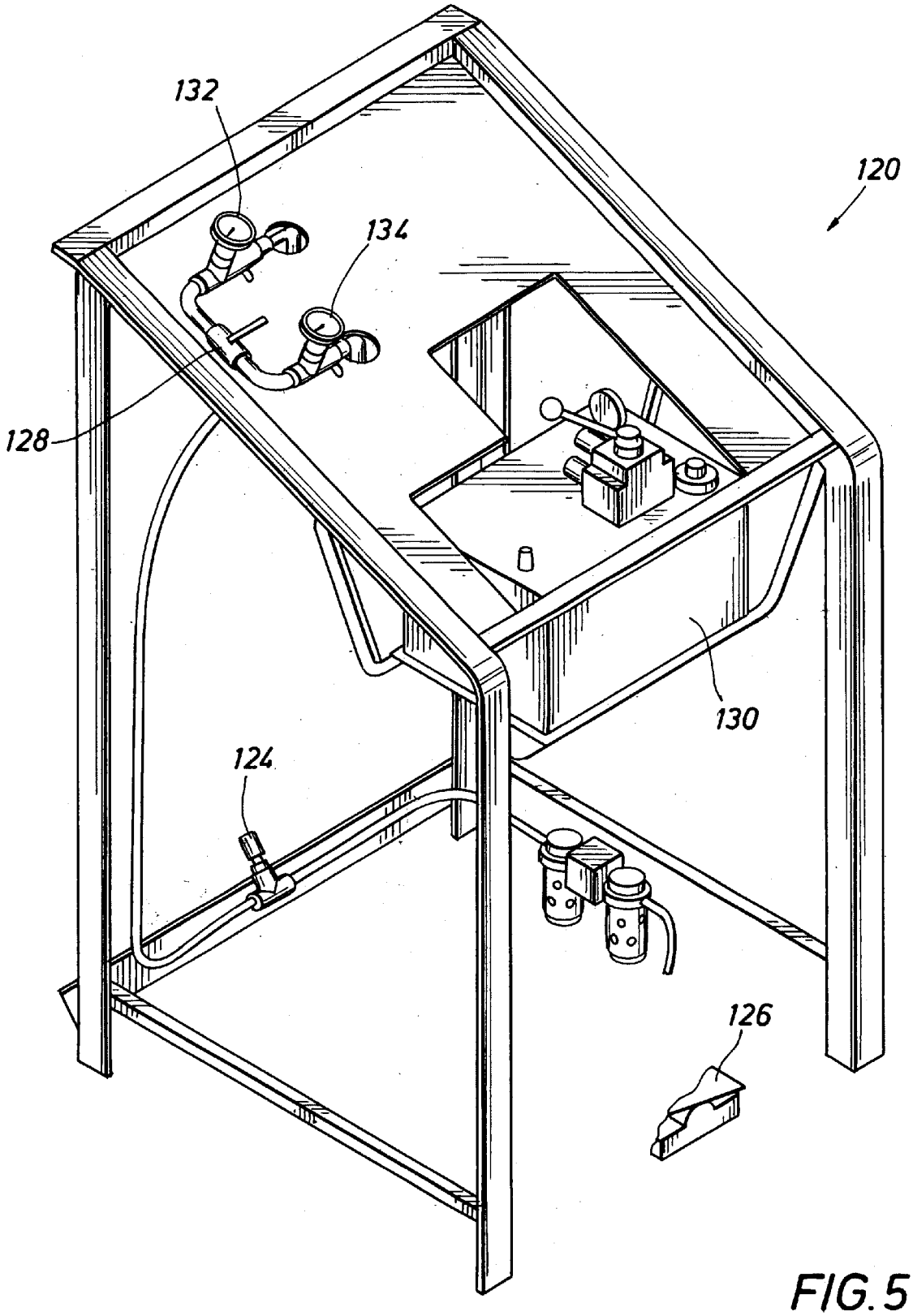
FIG. 5 is a perspective view of the front of the control panel for operating the pipe clamp and a set of power slips.

FIGS. 4 and 5 show a control panel 120 for controlling the pipe clamp 10 and a set of pneumatic power slips 60. A pressurized air supply (not shown) is attached to an air inlet 124. From the inlet 124, the pressurized air is split to travel to a foot valve 126 which controls the power slips 60, and to a hydraulic pump valve 128 which leads the hydraulic pump 130. Gauges 132, 134 on both the upstream and downstream sides of the hydraulic pump valve 128 let the operator carefully control the air supply to the hydraulic pump 130. The hydraulic pump 130 converts the air pressure into hydraulic pressure which is then fed to the actuator 50 in the pipe clamp 10. By controlling the hydraulic pressure, the operator can firmly grasp a pipe 15 with the pipe clamp 10 from a relatively remote location.

The pipe clamp 10 described above can be used in several different applications and scaled for different sizes of pipe, tubing, and casing. Further, the principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A pipe clamp comprising:

a. a gripping head surrounding an axis;

b. a chain around the gripping head and attached to a mount;

c. an actuator between the gripping head and the mount positioned to adjust the distance between the gripping head and the mount; and d. a plate with slots adapted to radially align the pipe clamp with respect to the axis.

2. The pipe clamp of claim 1, wherein the gripping head comprises a base and at least one jaw pivotally attached to the base.

3. The pipe clamp of claim 1 wherein the actuator is hydraulically actuated.

4. The pipe clamp of claim 3 wherein the actuator is connected to a control panel positioned away from the pipe clamp.

5. The pipe clamp of claim 1 further comprising a safety cage comprising protective sections with hinges, cutouts, and retaining pins, wherein the hinges are attached to the plate, the cutout is positioned and sized so that the pipe does not touch the sections and the sections are joined by the retaining pins.

6. The pipe clamp of claim 1 wherein the plate is fixed to a slip bowl.

7. The pipe clamp of claim 1 wherein the plate is fixed to a set of power tongs.

8. A pipe clamp comprising:

a. a gripping head comprising a base and at least one jaw pivotally attached to the base, the gripping head surrounding an axis;

b. a chain around the gripping head and attached to a mount;

c. a fluid pressure powered actuator between the gripping head and the mount, the actuator positioned to adjust the distance between the gripping head and the mount, the actuator being connected to a remote control panel; and d. a plate with slots adapted to align the head with respect to the axis.

9. The pipe clamp of claim 8, further comprising a safety cage comprising two protective sections with hinges, cutouts and retaining pins, wherein the hinges are attached to the plate, the cutout is positioned and sized so that the pipe does not touch the cages and the sections are joined by the retaining pins.

10. A method for securing pipe comprising the steps of:

a. providing a pipe clamp including a gripping head, the gripping head comprising:

i. a base and at least one jaw pivotally attached to the base about an axis;

ii. a chain about the gripping head, attached to a mount;

iii. a fluid pressure powered actuator between the gripping head and the mount positioned to adjust the distance between the gripping head and the mount, the actuator connected to a remote control panel; and iv. a plate with slots which keep the head and the mount radially aligned with respect to the axis;

b. positioning the pipe clamp such that the axis is nearly aligned with the axis of a pipe so that the gripping head surrounds the pipe; and c. engaging the actuator so that the chain tightens the gripping head around the pipe.

11. The method of claim 10, wherein the plate is fixed to a slip bowl.

12. The method of claim 10, wherein the plate is fixed to a set of power tongs.

* * * * *